US008075100B2

(12) United States Patent
Sugahara

(10) Patent No.: US 8,075,100 B2
(45) **Date of Patent: *Dec. 13, 2011**

(54) LIQUID TRANSPORTING APPARATUS

(75) Inventor: Hiroto Sugahara, Aichi-ken (JP)

(73) Assignee: Brother Kogyo Kabushiki Kaisha, Nagoya, Aichi-ken (JP)

( * ) Notice: Subject to any disclaimer, the term of this patent is extended or adjusted under 35 U.S.C. 154(b) by 784 days.

This patent is subject to a terminal disclaimer.

(21) Appl. No.: 12/053,567

(22) Filed: Mar. 22, 2008

(65) Prior Publication Data

US 2008/0237047 A1 Oct. 2, 2008

(30) Foreign Application Priority Data

Mar. 27, 2007 (JP) ..... 2007-082329

(51) Int. Cl.
*B41J 2/06* (2006.01)

(52) U.S. Cl. ..... 347/55

(58) Field of Classification Search ..... 347/54, 347/55

See application file for complete search history.

(56) References Cited

U.S. PATENT DOCUMENTS

| | | | | |
|---|---|---|---|---|
| 4,855,768 | A * | 8/1989 | Iino et al. | 347/55 |
| 5,144,340 | A * | 9/1992 | Hotomi et al. | 347/55 |
| 6,545,815 | B2 | 4/2003 | Kroupenkine et al. | |
| 6,926,382 | B2 | 8/2005 | Ito et al. | |
| 7,370,946 | B2 * | 5/2008 | Sugahara | 347/84 |
| 7,686,426 | B2 * | 3/2010 | Sugahara | 347/55 |
| 2005/0219330 | A1 | 10/2005 | Sugahara | |
| 2006/0001705 | A1 | 1/2006 | Sugahara | |
| 2006/0024207 | A1 | 2/2006 | Sugahara | |
| 2007/0070129 | A1 | 3/2007 | Sugahara | |

FOREIGN PATENT DOCUMENTS

| | | | |
|---|---|---|---|
| JP | 2003-177219 | A | 6/2003 |
| JP | 2003-326712 | A | 11/2003 |
| JP | 2005-288875 | A | 10/2005 |
| JP | 2006-015541 | A | 1/2006 |
| JP | 2006-015559 | A | 1/2006 |
| JP | 2006-035640 | A | 2/2006 |

OTHER PUBLICATIONS

United States Patent and Trademark Office, Office Action dated Jun. 11, 2009, received in U.S. Appl. No. 11/468,483.

* cited by examiner

*Primary Examiner* — An Do
(74) *Attorney, Agent, or Firm* — Baker Botts L.L.P.

(57) ABSTRACT

A head includes a common ink chamber, a plurality of individual electrodes which communicate with the common ink chamber, and a plurality of ink channels through which, an ink supplied from the common ink chamber flows. Each ink channel is provided with a first electrode which is common for the individual electrodes, a plurality of second electrodes corresponding to the individual electrodes respectively, and an insulating layer which covers the first electrode and the second electrodes. Furthermore, the individual electrode of each ink channel is associated with an individual electrode of another ink channel, and the corresponding second electrodes are in electrical conduction. Accordingly, it is possible to reduce a cost of an electrical system by reducing the number of wirings which are connected to electrodes provided to each of the liquid channels.

15 Claims, 13 Drawing Sheets

LIQUID TRANSPORTING APPARATUS

CROSS REFERENCE TO RELATED APPLICATION

The present application claims priority from Japanese Patent Application No. 2007-082329, filed on Mar. 27, 2007, the disclosure of which is incorporated herein by reference in its entirety.

BACKGROUND OF THE INVENTION

1. Field of the Invention

The present invention relates to a liquid transporting apparatus which transports a liquid.

2. Description of the Related Art

As a liquid transporting apparatus, an ink-discharge head which discharges an ink on to a printing medium such as a recording paper has hitherto been known. Such ink-discharge head includes a channel unit which has a plurality of individual ink channels including pressure chambers which communicate with nozzles, and an actuator which applies a pressure to the ink in the pressure chambers (Refer to Japanese Patent Application Laid-open No. 2003-326712 for example). However, in such ink-discharge head, as it is necessary to form individual ink channels of a multiple number of complex shapes in the channel unit, a manufacturing cost tends to become high. Moreover, for discharging a fixed quantity (a predetermined quantity) of ink, it is necessary to make a volume of the pressure chamber to be more than a predetermined volume. It is difficult to arrange closely (high integration) such individual ink channels having the complex shape including the pressure chambers, and therefore it is difficult to make the ink-discharge head to be a small size.

In view of the abovementioned situation, the inventor of the present invention has proposed a liquid transporting apparatus which transports an ink by an electrowetting phenomenon, as an apparatus which is capable of transporting a liquid, having a structure simpler than a structure of the conventional ink-discharge head (Refer to Japanese Patent Application Laid-open No. 2006-35640 for example). This liquid transporting apparatus includes a substrate in which a plurality of liquid channels is formed, individual electrodes (first individual electrode and second individual electrode) which are arranged at the middle in each of the liquid channels, and an insulating layer which covers the individual electrodes. When a voltage (driving electric potential) is not applied to the individual electrodes, a wetting angle of a liquid with respect to a surface of the insulating layer covering the individual electrodes is high, and the liquid cannot move onto the surface of the insulating layer. When the driving electric potential is applied to the individual electrodes and an electric potential difference is developed between the individual electrodes under the insulating layer and the liquid on the insulating layer, the wetting angle of the liquid with respect to the surface of the insulating layer becomes small (electrowetting phenomenon), and the liquid can move onto the surface of the insulating layer covering the individual electrodes. According to this arrangement, it is possible to transport the liquid independently in each of the liquid channels, only by changing (switching) the application of the driving electric potential to the two types of electrodes (first individual electrode and second individual electrode), without complicating the structure of the liquid channel.

SUMMARY OF THE INVENTION

In the liquid transporting apparatus disclosed in the Japanese Patent Application Laid-open No. 2006-35640, for transporting the liquid independently in the plurality of liquid channels, it is necessary to apply the driving electric potential independently to the individual electrodes (first individual electrode and second individual electrode) corresponding to the respective liquid channels. In other words, for applying the driving electric potential independently to each of the individual electrodes, the number of wirings same as the number of individual electrodes are necessary. However, for realizing the size reduction of the apparatus, when an attempt is made to arrange the individual channels highly densely, there arises a need to form a fine wiring pattern with a fine pitch. Because of a high cost for forming the wiring pattern, the cost of the electrical system becomes high.

An object of the present invention is to provide a liquid transporting apparatus in which it is possible to reduce the cost of the electrical system by decreasing the number of wirings connected to electrodes which are provided to the liquid channels.

According to a first aspect of the present invention, there is provided a liquid transporting apparatus which transports a liquid having an electroconductivity, including a common liquid chamber in which the liquid is supplied;

a plurality of liquid channels through which the liquid supplied from the common liquid chamber flows, each of the liquid channels including a plurality of individual channels which communicate with the common liquid chamber;

a plurality of first electrodes arranged on the liquid channels respectively, each of the first electrodes being provided in common to the individual channels of one of the liquid channels;

a plurality of second-electrode groups arranged on the plurality of liquid channels respectively, each of the second-electrode groups including a plurality of second electrodes arranged on the plurality of individual channels of one of the liquid channels, respectively;

an insulating layer which covers the second electrodes of each of the second-electrode groups and each of the first electrodes of one of the liquid channels, a wetting angle of the insulating layer with respect to the liquid being decreased to be not more than a critical wetting angle when an electric potential difference between the liquid in the liquid channel and at least one of the first and the second electrodes is not less than a predetermined critical electric potential; and an electric potential applying mechanism which applies an electric potential to the second electrodes of each of the second-electrode groups and each of the first electrodes of one of the liquid channels, and a second electrode included in one of the second-electrode groups corresponds to another second electrode included in another second-electrode group to electrically connect with each other.

In each liquid channel, when an electric potential difference is generated between the liquid and the first electrode, or between the liquid and the second electrode, a so-called electrowetting phenomenon in which, a wetting angle of the liquid with respect to the surface of the insulating layer which covers the electrode, decreases according to the electric potential difference, occurs (refer to Japanese Patent Application Laid-open Publication No. 2003-177219 for example). When the electric potential difference between the liquid and the electrode becomes same as the critical electric potential difference or more, and the wetting angle of the liquid with respect to the surface of the insulating layer (hereinafter, referred to as "the wetting angle of the surface of the insulating layer") decreases to the critical wetting angle or smaller, the liquid is capable of moving on the surface. When the electric potential difference between the liquid and the electrode is smaller than the critical electric potential difference, since the wetting angle of the liquid with respect to the surface of the insulating layer is greater than the critical wetting angle, the liquid cannot move on the surface of the insulating layer. Further, when the electric potential difference between the liquid and the electrodes is less than the critical electric potential difference, the liquid can not move onto the surface of the insulating layer because the wetting angle of the surface of the insulating layer is more than the critical wetting angle.

Here, even when the electric potential difference between the liquid and the second electrode which is provided to a certain individual channel becomes same as the critical electric potential difference or more, and the wetting angle of the insulating layer which covers these second electrodes is decreased to the critical wetting angle or smaller than the critical wetting angle, the liquid does not flow to that individual channel if the electric potential difference between the first electrode and the liquid is smaller than the critical electric potential difference. In other words, only when the electric potential difference between the first electrode and the liquid, and between the second electrode and the liquid is same as the predetermined electric potential or more, the liquid flows through the individual channel.

Therefore, even upon bringing in conduction the corresponding second electrodes among the liquid channels, and applying in common the same electric potential by one wiring to the plurality of second electrodes which are in mutual electrical conduction, it is possible to transport the liquid only through a desired individual channel by setting appropriately the electric potential of the first electrode. Consequently, as compared to a case of connecting wirings independently to all the second electrodes, it is possible to reduce the total number of wirings, and to reduce a cost of the electrical system.

In the liquid transporting apparatus of the present invention, each of the first electrodes and the second electrodes of each of the second-electrode groups of one of the liquid channels may be arranged adjacently in a flow direction of the liquid.

In this case, since the first electrode and the second electrode are adjacent in the direction of flow of the liquid, when the electric potential of these electrodes is switched, starting and stopping of transportation of the liquid is carried out promptly (rapidly). In other words, a highly responsive liquid transporting apparatus is achieved.

In the liquid transporting apparatus of the present invention, each of the liquid channels may further includes a main channel which communicates with the common liquid chamber; the individual channels of each of the liquid channels may be branched from the main channel; and the first electrodes may be arranged on the main channel in each of the liquid channels.

When a pressure inside the common liquid chamber which is positioned at an upstream side of the liquid channel is decreased substantially due to some reason, there is a possibility that a meniscus of the liquid inside the individual channel moves to the upstream side, and further, is sucked up to the common liquid chamber. However, in this case, in each liquid channel, since the main channel having a channel cross-sectional area larger than a cross-sectional area of the individual channel exists at the upstream side of the individual channels, the meniscus of the liquid is hardly sucked to the upstream side.

In the liquid transporting apparatus of the present invention, a cross-sectional area of a portion, of the main channel, at which an upstream end of each of the first electrodes is positioned may be smaller than a cross-sectional area of another portion of the main channel positioned at a downstream side of the main channel.

In this case, as the main channel on which the first electrode is arranged is a channel which is branched into the plurality of individual channels, the cross-sectional area of the main channel is larger as compared to a cross-sectional area of the individual channel. Whereas, it is preferable for stopping assuredly the movement of the liquid at an upstream-side end of the first electrode that the cross-sectional area at the portion positioned at the upstream end of the first electrode is small. However, when the cross-sectional area is made to be small throughout the entire length of the main channel, a channel resistance becomes substantial. Therefore, it is possible to stop assuredly the liquid at the upstream end of the first electrode, without making the channel resistance of the main channel substantial by making small the cross-sectional area of the main channel at the upstream end of the first electrode, and by making substantial the cross-sectional area at the downstream side thereof.

In the liquid transporting apparatus of the present invention, each of the first electrodes may be arranged, on the individual channels of one of the liquid channels, commonly for the individual channels of one of the liquid channels.

In this case, since the first electrode is arranged to be spread over the individual channels, the same electric potential is applied to each portion of the first electrode positioned at each of the individual channels. The first electrode may be arranged at any of the upstream side and the downstream side with respect to the plurality of second electrodes.

The liquid transporting apparatus of the present invention may further include a common electrode which is arranged on a surface of the common liquid chamber, the common electrode being in a direct contact with the liquid in the common liquid chamber, and being kept at a predetermined reference electric potential all the time.

In this case, since the liquid makes a contact with the common electrode which is kept at the reference electric potential all the time, the electric potential of the liquid is stable. Therefore, the electric potential between the liquid and the electrodes (the first electrode and the second electrode) does not wobble (is not unstable) when a predetermined electric potential is applied to the first electrode and the second electrode, and a stability of transporting the liquid is improved.

The liquid transporting apparatus of the present invention may further include a first channel forming member having a form of a substantially flat plate, and including, on one surface thereof, a first partition wall which partitions the liquid channels, and a second partition wall which partitions individual channels of each of the liquid channels; and a second channel forming member having a form of a substantially flat plate, and including, on one surface thereof, the first electrodes, the second electrodes, and the insulating layer covering the first electrodes and the second electrodes, and the one surface of the first channel forming member may be arranged to face the one surface of the second channel forming member, and the liquid channels may be formed between the first channel forming member and the second channel forming member.

In this case, it is possible to make flat a surface facing the second channel forming member by forming the first partition wall and the second partition wall in the first channel forming member. Consequently, it is possible to form easily the first electrode, the second electrode, and the insulating layer on the surface facing the second channel forming member.

In the liquid transporting apparatus of the present invention, through holes may be formed in an area, of the second channel forming member, overlapping with the first electrodes and the second electrode respectively; a plurality of wirings which connect the first electrodes, the second electrodes, and the electric potential applying mechanism may be formed on an opposite-surface of the second channel forming member, the opposite-surface being opposite to the one surface; and the wirings may be connected to the first electrodes and the second electrodes via an electroconductive material which is filled in the through holes. In this case, it is possible to form easily the wirings on a surface of the second channel forming member, on a surface opposite to the surface on which the electrodes are formed, and to connect easily these wirings, the first electrode, and the second electrode by the electroconductive material filled in the holes.

In the liquid transporting apparatus of the present invention, the second electrodes of each of the second-electrode groups may be aligned in a predetermined direction such that a position of a second electrode included in one of the second-electrode groups is same as a position of another second electrode included in another second-electrode groups, the second electrode corresponding to another second electrode. In this case, since the corresponding second electrodes are positioned at the same position in a predetermined direction in each second-electrode group, it is possible to ascertain easily a positional relationship of the second electrodes which are in mutual electrical conduction, and a control of the liquid transporting apparatus becomes easy.

In the liquid transporting apparatus of the present invention, the first electrode and the second electrode may be formed in the same plane, and the first electrode and the second electrode may be formed in different planes. Furthermore, in the liquid transporting apparatus of the present invention, each of the first electrodes may be arranged at a downstream side of the second electrode in the flow direction, and each of the first electrodes may be arranged at an upstream side of the second electrode in the flow direction. In this manner, a degree of freedom of arranging the electrodes is high, and in any of the cases, it is possible to transport the liquid through the desired individual channel by adjusting the electric potential to be applied to the first electrode and the second electrodes.

In the liquid transporting apparatus of the present invention, the liquid may be an ink. In this case, it is possible to use the liquid transporting apparatus as a printer which discharges the ink. Moreover, the ink may be electroconductive, irrespective of whether it is a color ink or a black ink. Moreover, it is applicable to both a dye ink and a pigment ink.

In the liquid transporting apparatus of the present invention, the insulating layer may be formed of a fluororesin. In this case, it is possible to form easily the insulating layer by a method such as a spin coating.

Moreover, according to the present invention, even when the same electric potential is applied in common via one wiring to the second electrodes which are in mutual electrical conduction upon bringing the corresponding second electrodes in conduction among the liquid channels, it is possible to transport the liquid only through the desired individual channel by setting appropriately the electric potential of the first electrode. Consequently, as compared to a case of connecting an independent wiring to all the second electrodes, it is possible to reduce the number of wirings, and to reduce the cost of the electrical system. For example, approximately 5000 nozzles are necessary for printing a recording paper of A4 size. In this case, in a case of connecting an independent wiring to the second electrode corresponding to each nozzle, approximately 5000 wirings are necessary. However, when these nozzles are divided into five groups, and five second electrodes are connected by a common wiring, the purpose is served by approximately 1000 wirings. In this case, when it is possible to make a printing frequency to be 1 kHz when approximately 5000 nozzles are wired independently, the printing frequency when the nozzles are divided into five groups becomes approximately 200 Hz. In this manner, it is possible to decrease the number of wirings substantially without lowering a printing speed substantially. Moreover, since one of the ground electric potential and the predetermined driving electric potential is to be supplied to the first electrode, the second electrodes and the common electrode, it is possible to reduce a cost of a driver (IC) which supplies the electric potential.

DETAILED DESCRIPTION OF THE PREFERRED EMBODIMENTS

An embodiment of the present invention will be described below with reference to FIGS. 1 to 8. This embodiment is an example in which the present invention is applied to a printer having an ink-discharge head which transports an ink to adhere onto a recording paper, and which records a desired image on the recording paper.

Figure 1:
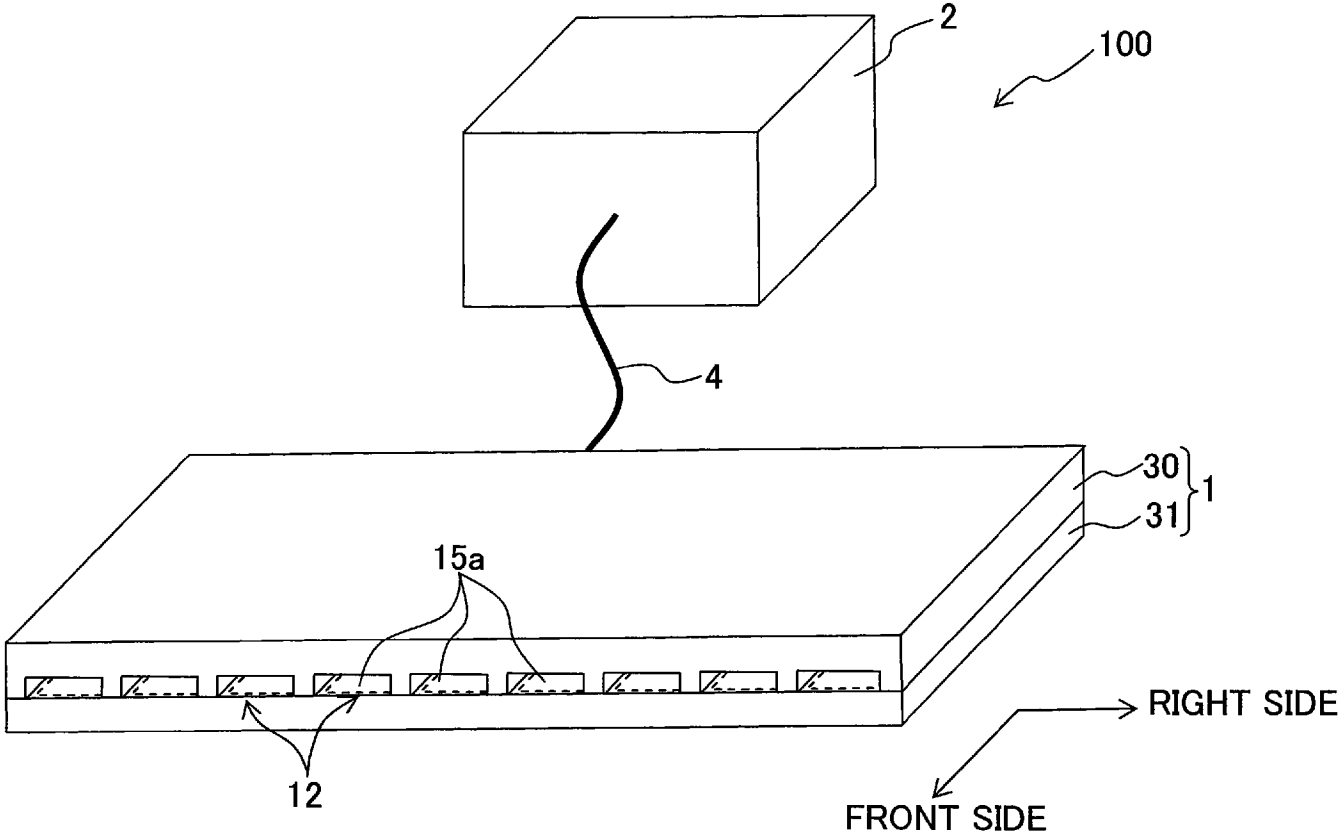
FIG. 1 is a schematic structural view of a printer according to an embodiment of the present invention.
Figure 2:
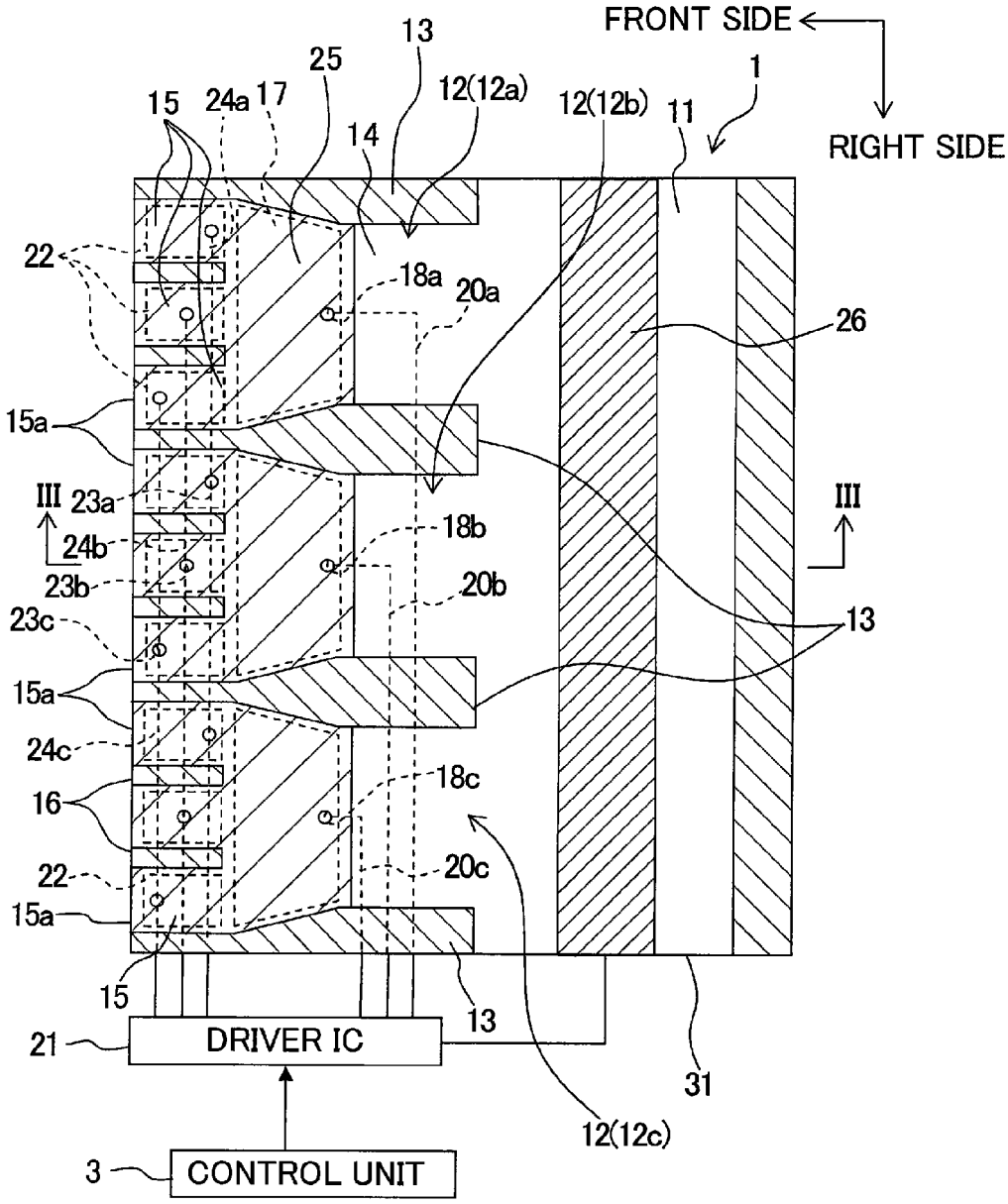
FIG. 2 is a horizontal cross-sectional view of a part of an ink-discharge head.

As shown in FIG. 1, a printer 100 includes an ink-discharge head which includes a plurality of ink channels each having a discharge port 35*a*, an ink tank 2 which is connected to the ink-discharge head 1 via a tube 4, and a control unit 3 which controls an ink transporting operation of the ink discharge head 1 (refer to FIG. 2). Moreover, the printer 100 records a desired image or the like on a recording paper P by discharging the ink toward the recording paper P (refer to FIGS. 5 to 8) which is positioned at a front side of the discharge ports 35*a*, from the discharge ports provided at a front end surface of the ink-discharge head 1. In the following explanation, front, rear, left, and right directions are defined by the directions as shown in FIG. 1.

Figure 3:
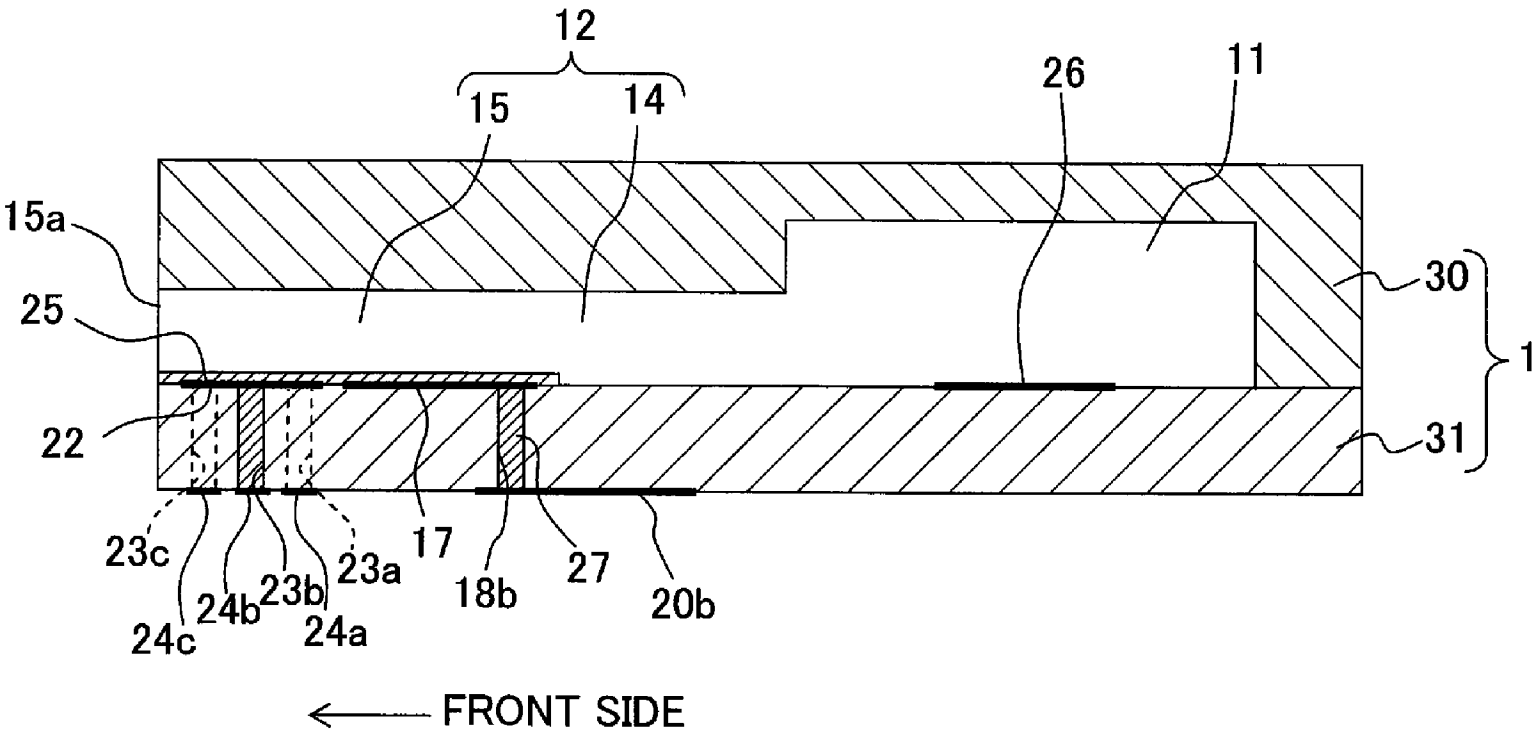
FIG. 3 is a cross-sectional view taken along a line IIIA-IIIA in FIG. 2.

Next, the ink-discharge head 1 will be described below. FIG. 2 is a horizontal cross-sectional view of a part of the ink-discharge head 1, and FIG. 3 is a cross-sectional view taken along a III-III line in FIG. 2. As shown in FIG. 1, the ink-discharge head 1 has a head body 10 which forms an outer frame of the ink discharge head 1. Moreover, the head body 10 includes two channel forming members 30 and 31 having a shape of a substantially flat plate with a rectangular shape which is longer in left and right direction in a plan view. These channel forming members 30 and 31 are joined in a state of facing mutually. The two channel forming members 30 and 31 are formed of a material such as a synthetic resin material such as polyimide, a glass material, and a silicon on a surface of which a silicon oxide film is formed, and has an insulating property at least on a surface which comes in contact with the ink and a surface on which electrodes 17 and 21, and wirings 20 and 24 are formed.

A common ink chamber 11 (common liquid chamber) extending in a longitudinal direction thereof, and a plurality of ink channels 12 each extending in a frontward direction upon branching from this common ink chamber 11 are formed between the two channel forming members 30 and 31 of the head 1. In FIG. 2, three ink channels 12 (12*a*, 12*b*, and 12*c*) in the plurality of ink channels 12 provided in the head body 10 are shown. Moreover, the ink used in the ink-discharge head 1 is an electroconductive ink having water as the main constituent thereof, such as an aqueous dye ink in which a dye and a solvent are added to water or an aqueous pigment ink in which pigments and a solvent are added to water.

The common ink chamber 11 is provided at an upstream side (rear side) of the plurality of ink channels 12, and communicates with all the ink channels 12. Moreover, this common ink chamber 11 is connected to the ink tank 2 (refer to FIG. 1). The ink supplied from the ink tank 2 to the ink-discharge head 1 is supplied to the ink channels 12 via the common ink chamber 11. The ink tank 2 is arranged at a position slightly higher than the position of the ink channel 12 inside the ink-discharge head 1, and a head pressure of the ink tank 2 acts all the time on the ink inside the ink channels 12 to generate a flow of ink toward the discharge port 35*a*.

A common electrode 26 extending in a left-right direction which is a longitudinal direction of the common ink chamber 11 is formed on a bottom surface (liquid chamber forming surface) of the common ink chamber 11, and the ink inside the common ink chamber 11 makes a direct contact with the common electrode 26. Moreover, as shown in FIG. 2, the common electrode 26 is connected to a driver IC 21, and is kept at a ground electric potential (reference electric potential) all the time by the driver IC 21. Consequently, an electric potential of the ink inside the common ink chamber 11 which is in contact with the common electrode 26 is kept at the ground electric potential all the time.

The ink channels 12 are partitioned mutually by partition walls 13 (first partition walls) which are extended in the back and forth direction between the ink channels 12. Each ink channel 12 has a main channel (arterial channel) 14 which communicates with the common ink chamber 11, and three individual channels 15 (15*a*, 15*b*, and 15*c*) which are branched from the main channel 14. The ink is supplied to the main channel 14 of each ink channel 12 from the common ink chamber 11. Moreover, the three individual channels 15*a* to 15*c* of each the ink channels 12 are partitioned mutually by partition walls 16 (second partition walls) which are extended in back and forth direction between the three individual channels 15*a* to 15*c*. Furthermore, the discharge port 35*a* which is opened frontward is provided at a front end of each of individual channels 15*a* to 15*c*. As shown in FIGS. 1 and 2, the plurality of discharge ports 35*a* are arranged in a row in left and right direction in a front surface of the head body 10.

The partition walls 13 which partition the ink channels 12, and the partition walls 16 which partition the three individual channels 15*a* to 15*c* of each of the ink channels 12 are formed on a lower surface of the channel forming member 30 which is arranged at an upper side of the head body 10. On the other hand, an upper surface of the channel forming member 31 arranged at a lower side of the head body 10 is formed to be a flat surface. Moreover, the lower surface of the channel forming member 30 on which the partition walls 13 and 16 are formed, and the upper flat surface of the channel forming member 31 are joined and a plurality of ink channels 12 is formed between the two surfaces.

As shown in FIG. 2, with regard to the main channel 14 of each of the ink channels 12, a width of the channel at a downstream-side portion (rear-end portion) is constant, and a channel width of the upstream-side portion is gradually widened (increases gradually) toward the downstream (front side), and has a so-called inverse tapered shape. In other words, also a channel cross-sectional area of the downstream-side portion of the main channel is gradually widened toward the downstream (front side). The first electrode 17 has a trapezoidal shape in a plan view, and covers almost entire area of a bottom surface at the downstream-side portion of the bottom surface of the main channel (channel forming surface, first surface). This first electrode 17 is provided in common for the three individual channels 15*a* to 15*c* which are branched from the downstream side portion (front end portion) of the main channel 14. Moreover, an upstream end (short side of the trapezoidal shape) of the first electrode 17 is positioned at a boundary location of the upstream side portion and the downstream side portion of the main channel 14, at which the channel width of the main channel 14 changes.

In the three main channels 14 of the channel forming member 31 arranged at the lower side of the head body 10, three through holes 18*a*, 18*b*, and 18*c*, which are extended from an area on which the first electrode 17 is formed, up to the lower surface of the channel forming member 31 are formed by a method such as a laser machining. As shown in FIG. 3, an electroconductive material 27 is filled in each of the through holes 18*a* to 18*c*. On a lower surface of the channel forming member 31, three wirings 20*a*, 20*b*, and 20*c* which are extended from the three through holes 18*a* to 18*c*, up to an end portion in a longitudinal direction of the channel forming member 31 are formed. As shown in FIG. 2, the three first electrodes 17 are connected to the driver IC 21 (electric potential applying mechanism) which is a driving circuit, via the wirings 20*a* to 20*c* and the electroconductive material 27 filled in the three through holes 18*a* to 18*c*. This driver IC 21 selectively applies the predetermined driving electric potential and the ground electric potential to the first electrode 17.

The three individual channels 15*a* to 15*c* are branched from each of the main channels 14. Bottom surface (channel forming surface, second surface) of these three individual channels 15*a* to 15*c* is almost covered by three second electrodes 22 (22*a*, 22*b*, and 22*c*) having a rectangular shape in a plan view. These three second electrodes 22 (22*a* to 22*c*) form an electrode group. These three second electrodes 22*a* to 22*c* are arranged adjacent to the first electrode 17, in a back and forth direction which is a direction of flow of ink. Moreover, in the channel forming member 31 at the lower side, three through holes 23*a*, 23*b*, and 23*c* which are extended from an area of the three individual channels 15*a* to 15*c* in which the second electrodes 22*a*, 22*b*, and 22*c* are formed, up to the lower surface of the channel forming member 31 are formed by a method such as the laser machining, and an electroconductive material 28 is filled also in the through holes 23*a* to 23*c*.

Here, between the three individual channels 15*a* to 15*c*, which are branched from the main channel 14, positions at which the through holes 23*a* to 23*c* are formed are mutually shifted in the back and forth direction. In other words, as shown in FIG. 2, the through hole 23*a* is formed at a position overlapping with a rear end portion of the second electrode 22*a* in the individual channel 15 on a left side (upper side in FIG. 2). Moreover, the through hole 23*b* is formed at a position overlapping with a central portion of the second electrode 22*b*, in the individual channel 15 at the center. Furthermore, the through hole 23*c* is formed at a position overlapping with a front end portion of the second electrode 22*c*, in the individual channel 15 on a right side (lower side in FIG. 2).

As shown in FIGS. 2 and 3, in the lower surface of the channel forming member 31 arranged at the lower side of the head body 10, three wirings 24*a*, 24*b*, and 24*c* which are extended along a longitudinal direction (left and right direction) of the head body 10 are formed. The wiring 24*a* connects the through hole 23*a* which is formed at the same position in the back and forth direction. Similarly, the wirings 24*b* and 24*c* connect the through holes 23*b* and 23*c*. In this manner, the second electrodes 22*a* provided to each of the ink channels 12 are in mutual electrical conduction via the wiring 24*a* and the electroconductive material 28 in the through hole 23*a*. Similarly the second electrodes 22*b* and 22*c* are in mutual electrical conduction via the wirings 24*b* and 24*c* and the electroconductive material 28 in the through holes 23*b* and 23*c*.

Concretely, as shown in FIG. 2, the three second electrodes 22*a* positioned at the left side (upper side in FIG. 2) of the ink channel 12 communicate mutually via the wiring 24*a*; the three second electrodes 22*b* positioned at the center of the ink channel 12 communicate mutually via the wiring 24*b*; and the three second electrodes 22*c* positioned at the right side (lower side in FIG. 2) of the ink channel 12 communicate mutually via the wiring 24*c*. These second electrodes 22*a* to 22*c* in mutual electrical conduction are connected to the drive IC 21 (electric potential applying mechanism) which is a driving circuit, via the wirings 24*a* to 24*c*. One of the predetermined electric potential and the ground electric potential is selectively applied to the second electrodes 22*a* to 22*c* in mutual electrical conduction, from the driver IC 21. According to this structure, the total number of wirings even when combined for the first electrode 17 and the second electrodes 22*a* to 22*c* is six, and it is possible to reduce the number of wirings as compared to the number of wirings in a case in which a wiring is connected independently to each of the second electrodes 22*a* to 22*c* (number of wirings is 9).

It is possible to form the first electrode 17, the second electrodes 22*a* to 22*c*, and the common electrode 26 on the upper surface of the channel forming member 31 at the lower side by using a method such as a screen printing, a vapor deposition method, and a sputtering method.

As shown in FIG. 2, the driver IC 21 is connected to the first electrode 17, the second electrodes 22*a* to 22*c*, and the common electrode 26. The driver IC 21, for example, is provided at a position away from the head body 10, and is connected to the wirings 20*a* to 20*c* in conduction with the first electrode 17 and the wirings 24*a* to 24*c* in conduction with the second electrodes 22*a* to 22*c*, via a wiring member such as an FPC (Flexible Printed Circuit). The driver IC 21 may be arranged on the lower surface of the channel forming member 31, and may be connected directly to the wirings 20*a* to 20*c*, and the wirings 24*a* to 24*c* without a wiring member such as an FPC.

As shown in FIGS. 2 and 3, on a bottom surface of the downstream side portion of the main channel 14 and a bottom surface of the three individual channels 15 branched from the main channel 14, an insulating layer 25 made of a fluororesin is provided to cover completely the first electrode 17 and the second electrodes 22*a* to 22*c*. It is possible to form the insulating layer 25 by coating a fluororesin on a surface of the first electrode 17 and second electrode 22 by a method such as a spin coating method, for example.

Figure 6:
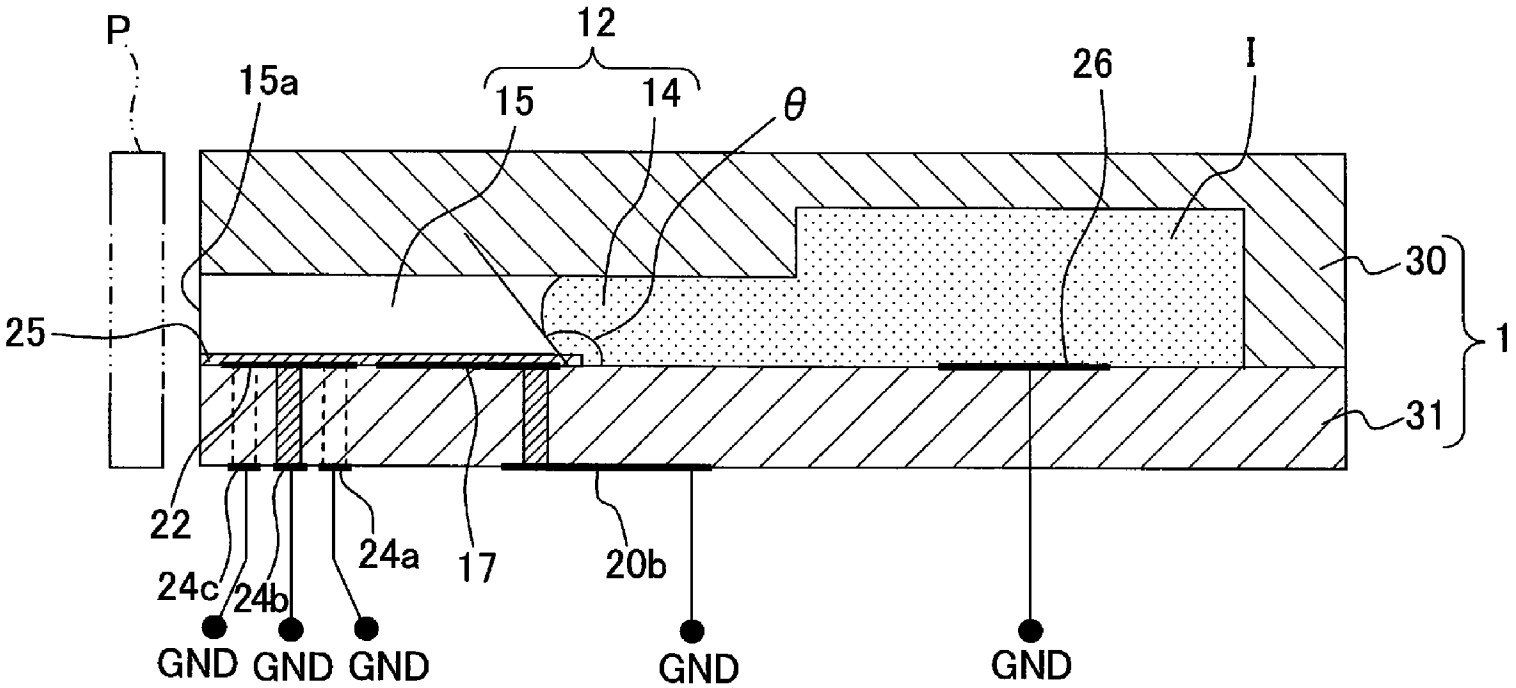
FIG. 6 is a cross-sectional view taken along a line VI-VI in FIG. 5.

Here, the electrodes (first electrode 17 and second electrodes 22) are at the ground electric potential, and with no electric potential difference between the electrodes and the ink which is kept at the ground electric potential, a liquid repellent property of a surface of the insulating layer 25 is higher than a liquid repellent property of the surface of the channel forming members 30 and 31 in which the ink channels 12 are formed. In other words, a wetting angle θ of the ink I with respect to the surface of the insulating layer 25 is greater than a wetting angle of the ink I with respect to an inner surface of the ink channel 12, at an area on which the insulating layer 25 is not formed. Therefore, as shown in FIG. 6, in this state, it is not possible to move the ink I on the surface of the insulating layer 25.

However, when a predetermined driving electric potential which is different from the ground electric potential is applied to the first electrode 17 and second electrodes 22 (22*a* to 22*c*), the electric potential difference is developed between the ink inside the ink channel 12 and the first electrode 17 and the second electrodes 22*a* to 22*c*. A surface energy between the ink and the insulating layer 25 changes due to the electric potential difference, and as a result, the wetting angle of the surface of the insulating layer 25 with respect to the ink I changes. In other words, as shown in FIG. 4, greater the potential difference V between the ink and the electrodes, the wetting angle θ of the ink with respect to the surface of the insulating layer 25 becomes small (electrowetting phenomenon).

Figure 4:
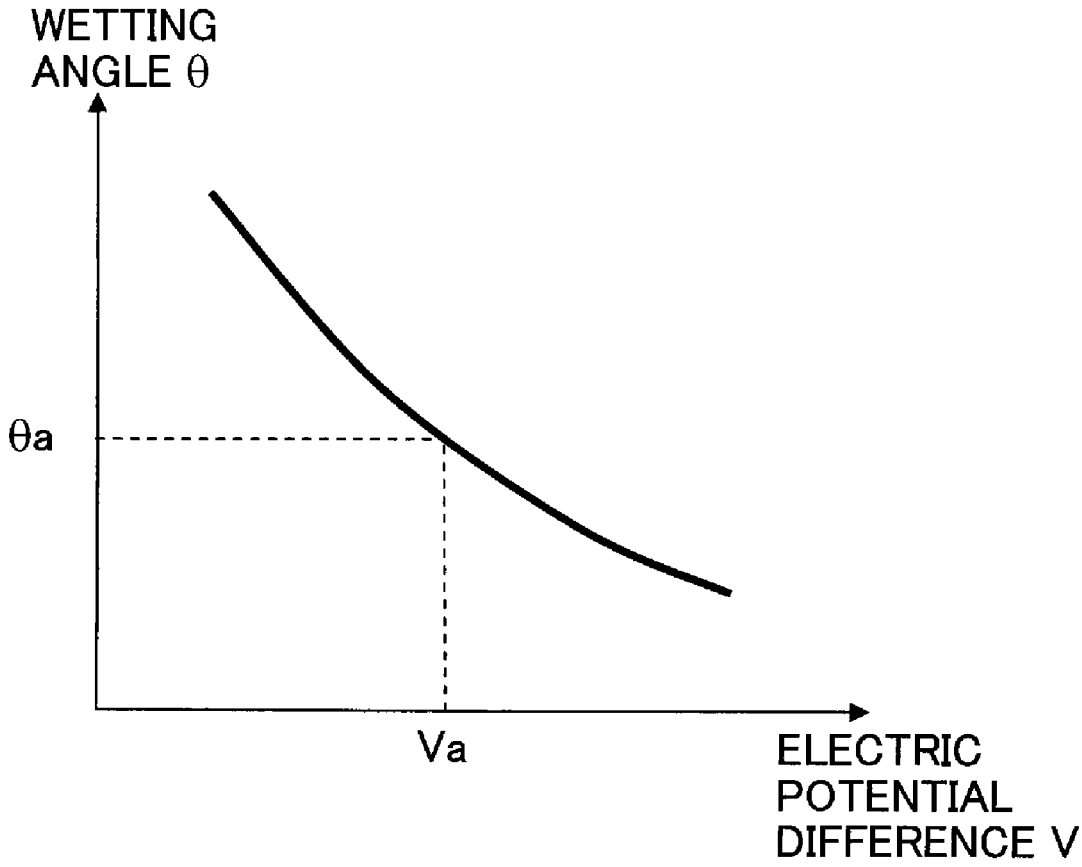
FIG. 4 is a diagram showing a relationship of an electric potential difference V between an ink and an electrode, and a wetting angle θ of a surface of an insulating layer which covers the electrode.

In the ink channel 12, when the electric potential difference between the ink and the electrodes 17, 22 (the first electrode 17 and the second electrodes 22 (22*a* to 22*c*)) is same as or higher than a critical electric potential difference Va shown in FIG. 4, the wetting angle θ of the surface of the insulating layer 25 is lowered up to a predetermined critical wetting angle θa or less. Therefore, the ink is capable of moving to an area of the insulating layer 25, which covers the electrode to which the driving electric potential is applied. The critical wetting angle θa is determined primarily (uniquely) by factors such as the head pressure of the ink tank 2 acting on the ink inside the ink channel 12, a channel shape of the ink channel 12 (particularly, a cross-sectional area of the channel), and a surface tension of the ink.

In each of the ink channels 12, the first electrode 17 provided to the main channel 14 and the second electrodes 22 (22*a* to 22*c*) provided to the individual channel 15 branching from the main channel 14 are arranged side by side in the direction of flow of ink (back and forth direction). Consequently, only when the electric potential is applied to both the first electrode 17 and the second electrodes 22 (22*a* to 22*c*), the ink crosses (over) the surface of the insulating layer 25 which covers the first electrode 17 and the second electrodes 22 (22*a* to 22*c*), and is discharged from the discharge ports 35*a* at the downstream.

As it has been described above, when all the partition walls 13 and 16 which partition the channels, are formed on the lower surface of the channel forming member 30 at the upper side, it is possible to let to be flat the upper surface of the channel forming member 31 at the lower side, which is joined to the lower surface of the channel forming member 30. In this case, it is possible to form easily the first electrode 17, the second electrodes 22 (22*a* to 22*c*), and the common electrode 26 simultaneously by a method such as the screen printing. Moreover, it is possible to form easily with a uniform thickness the insulating layer 25 covering the first electrode 17 and the second electrodes 22 (22*a* to 22*c*) by a method such as the spin coating method. At this time, it is desirable that the insulating layer 25 is formed continuously without a break, but a breakage may be formed in an area not overlapping with the electrode.

Moreover, it is also possible to form a part of or all of the partition walls 13 and 16 on the upper surface of the channel forming member 31 arranged at the lower side of the head body 10, and to form the first electrode 17, the second electrodes 22 (22*a* to 22*c*), and the common electrode 26 on the channel forming surface which is partitioned by the partition walls 13 and 16.

Next, a control unit 3 will be described below. The control unit 3 shown in FIG. 2 includes a Central Processing Unit (CPU), a Read Only Memory (ROM) in which data and various computer programs which control an overall operation of the printer 100 are stored, and a Random Access Memory (RAM) which stores temporarily data etc. which is to be processed by the CPU. Moreover, the control unit 3 controls various operations of the printer 100 so that the ink is discharged from the desired discharge port 35*a* of the ink-discharge head 1 based on external input data from a PC etc. Concretely, the control unit 3 controls the driver IC 21 which applies the electric potential to the first electrode 17 and the second electrodes 22 (22*a* to 22*c*), and/or a paper feeding mechanism (omitted in the diagram) which transports the recording paper P.

Next, the control of the driver IC 21 by the control unit 3 will be described below in detail. The control unit 3 controls the drive IC 21, and selectively applies one of the driving electric potential and the ground electric potential to the first electrode 17 and the second electrodes 22 (22*a* to 22*c*) of each ink channel 12. Accordingly, the control unit 3 makes the ink be discharged from the discharge port 35*a* of the desired individual channel 15 of the ink-discharge head 1, and makes the ink be not discharged from the discharge port 35*a* of the individual channel 15 other than the desired individual channel 15.

Figure 5:
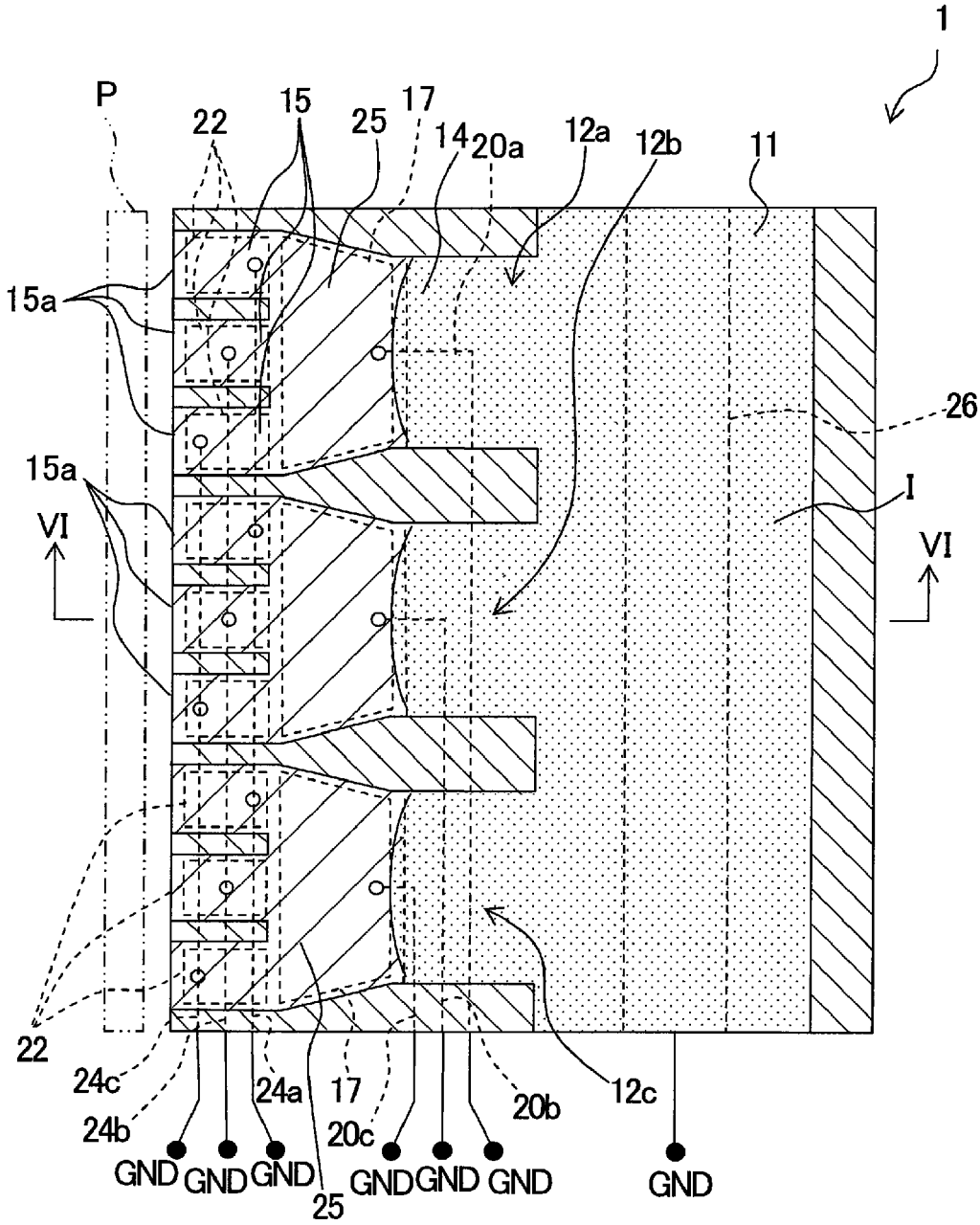
FIG. 5 is a horizontal cross-sectional view of the ink-discharge head in a standby state.

Next, an ink discharging operation of the ink-discharge head 1 will be described more concretely with reference to FIGS. 5 to 8. In FIGS. 5 and 8, '+' shows a state in which the driving electric potential (30 V for example) is applied to the electrode (first electrode 17 or second electrodes 22) via the wiring, and 'GND' shows a state in which the ground electric potential is applied to the electrode (first electrode 17 or second electrodes 22) via the wiring.

As shown in FIGS. 5 and 6, in the state in which the ground electric potential is applied from the driver IC 21 to the first electrode 17 of all the ink channels 12 (12*a* to 12*c*) via the wirings 20*a* to 20*c*, there is almost no electric potential difference between the first electrode 17 and the ink inside the main channel 14, and the electric potential difference is sufficiently smaller than the critical electric potential difference Va shown in FIG. 4. Consequently, the wetting angle of the ink with respect to the area of the insulating layer 25 covering the first electrode 17 is greater than the critical wetting angle θa, and the ink does not move onto this area. Therefore, in all ink channels 12, a meniscus of the ink I is formed at a position of an upstream end of the first electrode 17, and a state of no ink being discharged from the discharge port 35*a* (standby state) is assumed. In this standby state, since the ink does not reach up to a position of the second electrodes 22, the electric potential of the second electrodes 22 has no effect on the ink, but for a reduction in electric power consumption, the ground electric potential is applied even to the second electrodes 22 via the driver IC 21 via the wirings 24*a* to 24*c*.

Moreover, when at the standby state shown in FIGS. 5 and 6, for holding assuredly the meniscus of the ink I at an end at the upstream side of the first electrode 22, it is preferable to make as small as possible a channel cross-sectional area of a portion positioned at the upstream end of the first electrode 17. On the other hand, when the channel cross-sectional area is made smaller throughout the overall length of the main channel 14, a flow resistance of the channel (channel resistance) becomes high. Therefore, in the embodiment, the channel width (channel cross-sectional area) of the portion of the main channel 14 positioned at the upstream end of the electrode 17 is smaller than the channel width of the portion at the downstream side thereof. Accordingly, the channel resistance of the main channel 14 is not increased to be more than necessary, and it is possible to stop assuredly the ink at the upstream end of the first electrode 17.

Figure 7:
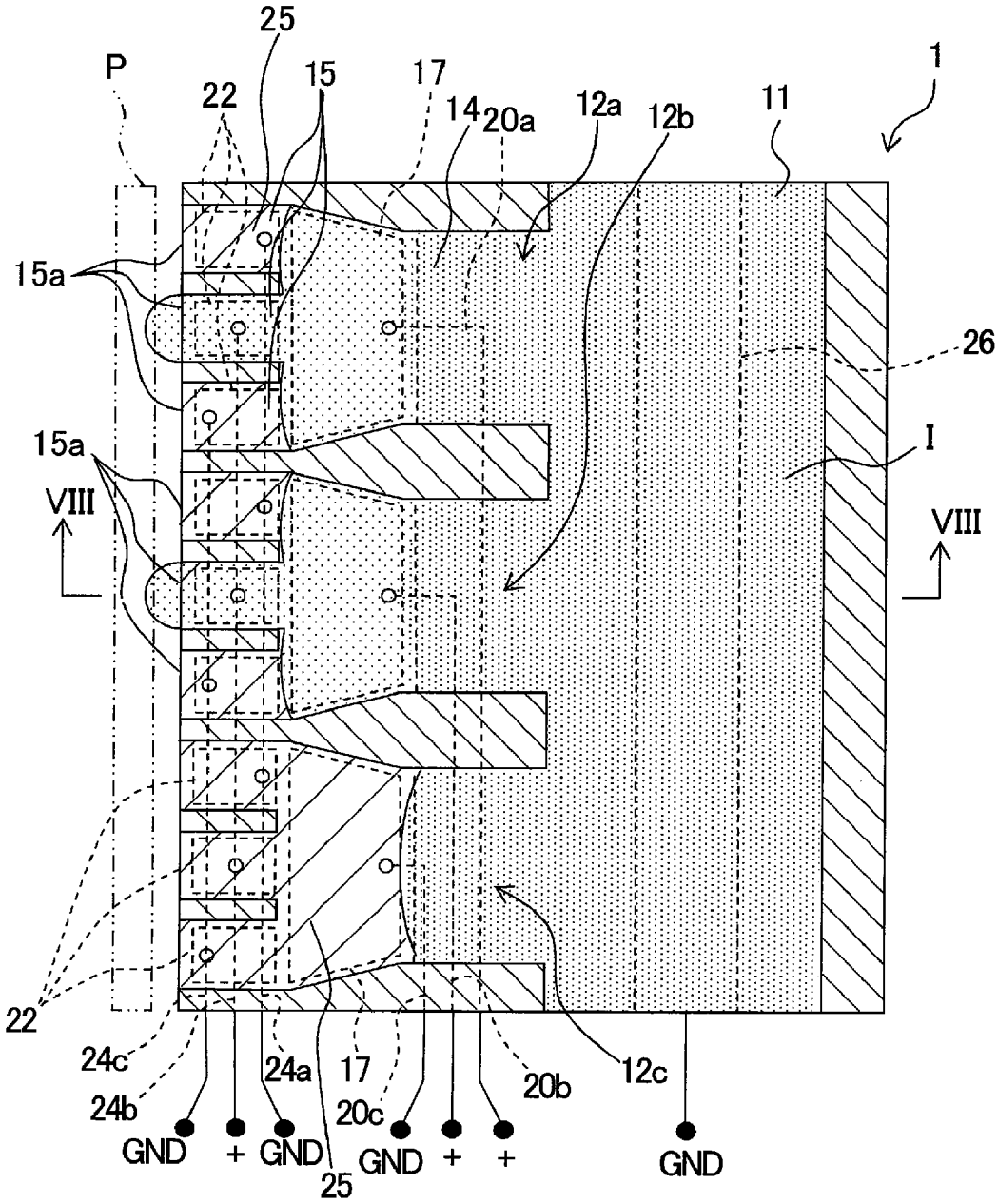
FIG. 7 is a horizontal cross-sectional view of the ink-head in a state of discharging the ink from a discharge port.
Figure 8:
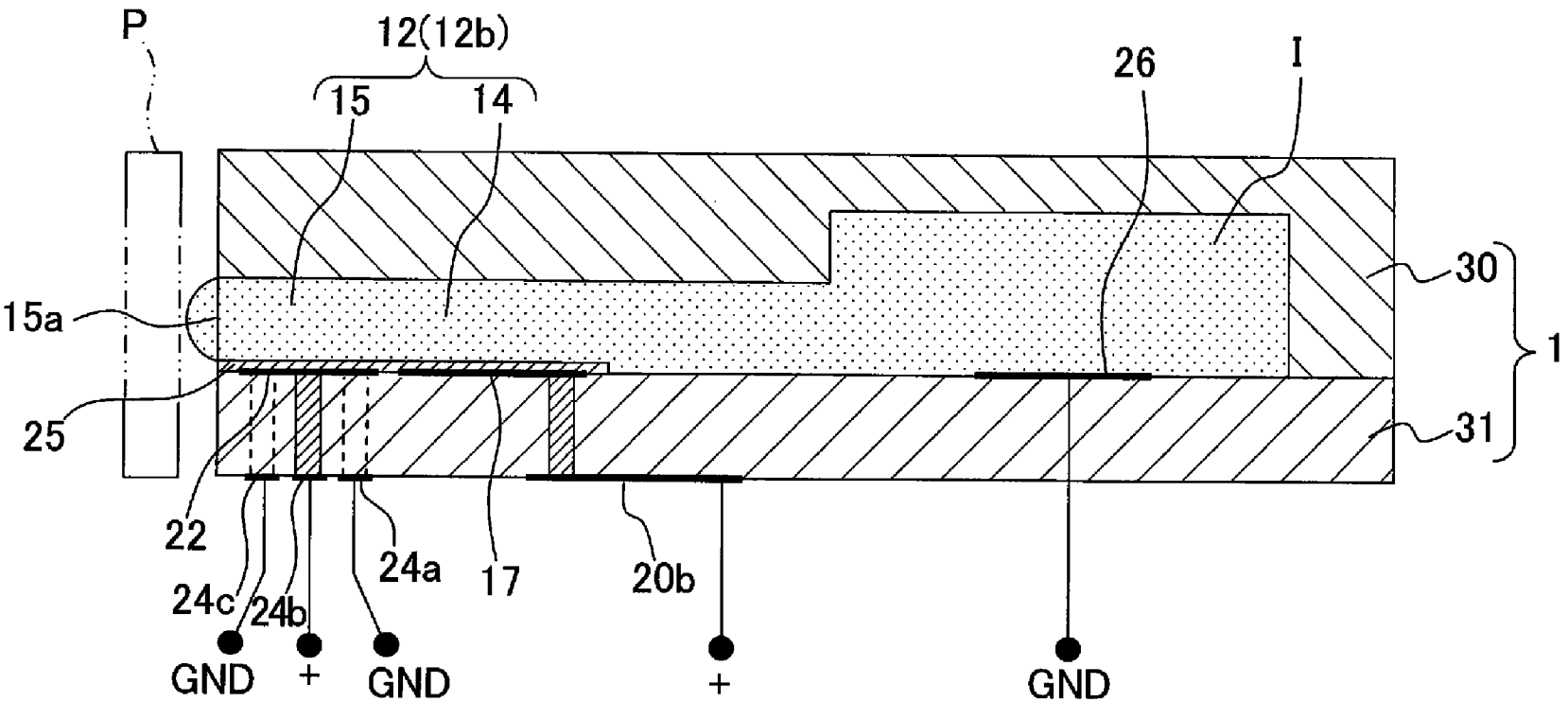
FIG. 8 is a cross-sectional view taken along a line VIII-VIII in FIG. 7.

Next, as shown in FIGS. 7 and 8, in each of the two ink channels 12*a* and 12*b* positioned at the left side and the center (upper side in FIG. 7), a situation, in which a command which makes discharge the ink from the central individual channel 15*b* is input to the control unit 3, is considered. As the command is input to the control unit 3, the driver IC 21, upon receiving the command from the control unit 3, applies the driving electric potential to the first electrodes 17 of the two ink channels 12*a* and 12*b* positioned at the left side and the center, via the two wirings 20*a* and 20*b*. As the driving electric potential is applied to the electrodes 17, since the wetting angle θ of the ink with respect to the insulating layer 25 covering the these first electrodes 17 is lowered up to the critical wetting angle θa or less, the ink I flows to the portion at the downstream side (trapezoidal shaped area) of the main channel 14, in each of the two ink channels 12*a* and 12*b* at the left side and the center.

Further, the driver IC 21 applies the driving electric potential to the three second electrodes 22*b* in mutual electrical conduction, which are provided to three individual channels 15*b* at the center of the three ink channels 12, via one wiring 24*b*. As the driving electric potential is applied to the three second electrodes 22, the wetting angle θ of the ink with respect to the insulating layer 25 covering these second electrodes 22 is lowered up to the critical wetting angle θa or less. Consequently, the ink I flows to the individual channel 15*b* at the center and the ink is discharged from the discharge port 35*a*, in each of the two ink channels 12*a* and 12*b* at the left side and the center.

On the other hand, in the ink channel 12 at the right side, since the driving electric potential is not applied to the first electrode 17, the ink has not flowed up to the portion at the downstream side of the main channel 14. Therefore, even when the driving electric potential is applied to the second electrode 22*b* at the center, the ink does not flow to the individual channel 15*b* at the center, and the ink is not discharged from the discharge port 35*a* of this individual channel 15*b*.

As it has been described above, the common electrode 26 which makes a direct contact with the ink inside the common ink chamber 11, and which is kept at the ground electric potential all the time is provided on the bottom surface of the common ink chamber 11. Therefore, the electric potential of the ink inside the ink channel 12 is stable, and the electric potential difference between the electrodes 17, 22 (the first electrode 17 and the second electrodes 22) and the ink is stable. In other words, since there hardly occurs to be a malfunction of the ink being discharged unintentionally due to a fluctuation (change) in the electric potential of the ink when the driving electric potential is not applied to the first electrode 17 and the second electrodes 22, stability of the ink discharging operation is improved.

As shown in FIG. 7, when the ink exists in the individual channel 15, and a pressure on the ink (back pressure) inside the common ink chamber 11 positioned at the upstream side of the ink channel 12 is lowered due to some reason, the meniscus of the ink I inside the individual channel 15 moves to the upstream side, and further the ink may be sucked up to the common ink chamber 11. However, in the embodiment, in each of the ink channels 12, there exists at the upstream side of the three individual channels 15, the main channel 14 having the channel width (channel cross-sectional area) larger than the channel width of these individual channels 15. The meniscus of ink has a tendency to move toward a channel having a small cross-sectional area due to an effect of the surface tension (capillary force), when the main channel 14 having the cross-sectional area larger than the cross-sectional area of the individual channel 15 is formed between the individual channel 15 and the common ink chamber 11, a force to obstruct the movement of the meniscus from the individual channel 15 to the main channel 14 at the upstream side is exerted. Consequently, even when there is a pressure drop in the common ink chamber 11 at the upstream side, the meniscus of the ink I is hardly sucked toward the upstream side.

In each of the ink channel 12, the first electrode 17 arranged in the portion at the downstream side of the main channel 14 and the three second electrodes 22 (22*a* to 22*c*) arranged in the three individual channels 15 (15*a* to 15*c*) branched from the main channel 14 are mutually adjacent. Therefore, when the electric potential is switched, a movement/stopping of the ink in the ink channel are carried out promptly. In other words, a response of the discharge operation of the ink-discharge head 1 is improved.

In the abovementioned explanation, an ink-discharge head in which the ink is discharged from the discharge port 35*a* of the individual channel 15*b* positioned at the center, in each of the two ink channels 12*a* and 12*b* at the left side and the center respectively, is exemplified. As a matter of course, it is possible to discharge from the discharge port 35*a* of another individual channels 15*a* and 15*c*. In other words, the driving electric potential may be applied to the first electrode 17 provided in the main channel 14 of the ink channel 12 to which the predetermined channel 15 from which the ink is to be discharged belongs, and the driving electric potential may also be applied to the second electrodes 22 provided in the predetermined individual channel 15.

As it has been described above, each of the ink channels 12 of the ink-discharge head 1 is provided with the first electrode 17 in common for the three individual channels 15 (15*a* to 15*c*), and three second electrodes 22 (22*a* to 22*c*) corresponding to the three individual channels 15 (15*a* to 15*c*) respectively. The first electrode 17 and the three second electrodes 22 are covered by the insulating layer 25. Only when both of the electric potential differences, that is, the electric potential difference between the first electrode 17 and the ink, and the electric potential difference between the second electrodes 22 and the ink become same as the predetermined electric potential or more, the ink flows into the individual channel 15, and the ink is discharged from the discharge port 35*a*. In this case, it is possible to discharge the ink only from the desired individual channel 15 when the electric potential is applied appropriately to the first electrode 17. Moreover, the second electrodes 22 corresponding to the ink channels 12 can be connected electrically, and the same electric potential can be applied commonly by one wiring 24 to the second electrodes 22 which are in conduction. Consequently, it is possible to decrease the total number of wirings as compared to a case in which an independent wiring is connected to each of the second electrodes 22, and to reduce the cost of an electrical system.

Next, modified embodiments in which various modifications are made in the embodiment will be described below. However, same reference numerals are assigned to components having a structure similar as in the embodiment, and the description of such components is omitted.

First Modified Embodiment

In the embodiment, as shown in FIG. 2, the first electrode in common for the plurality of individual channels is arranged, in each of the ink channels, at the upstream side of the plurality of second electrodes which are provided to the plurality of individual channels respectively. However, the first electrode may be arranged at a downstream side of the plurality of second electrodes.

Figure 9:
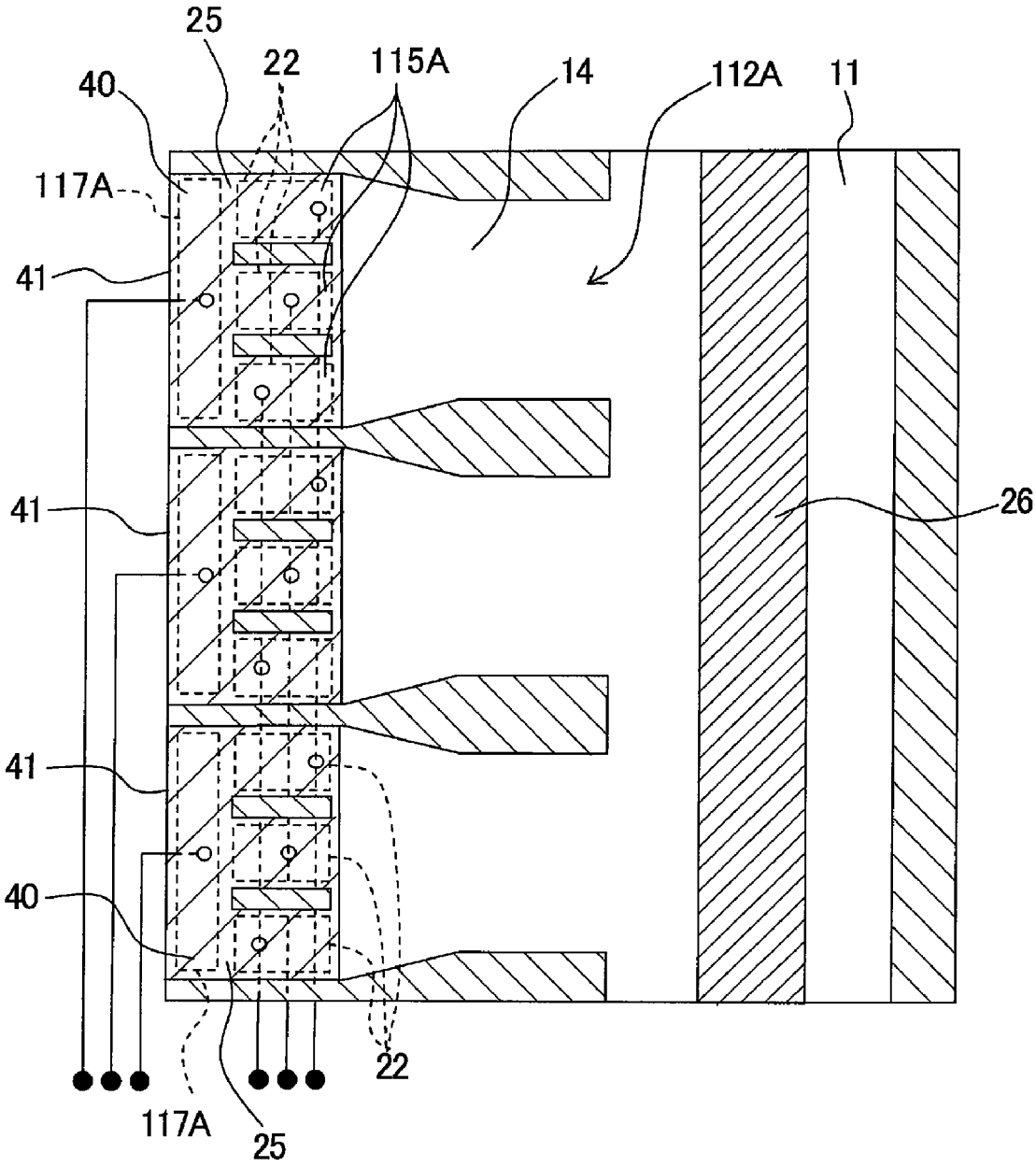
FIG. 9 is a horizontal cross-sectional view of an ink-discharge head in a first modified embodiment.

For example, as in a first example shown in FIG. 9, a short channel 40 to which a plurality of individual channels 115A are joined may be provided on a downstream side of the individual channels 115A of each ink channel 112A, and a first electrode 117A may be arranged in this channel 40. In this case, since a discharge port 41 which communicates with the channel 40 is in common for the three individual channels 115A, there is a fear that a small amount of ink which has flowed from the adjacent individual channel 115A may be mixed with the ink which is discharged from a discharging area corresponding to certain individual channel 115A.

Figure 10:
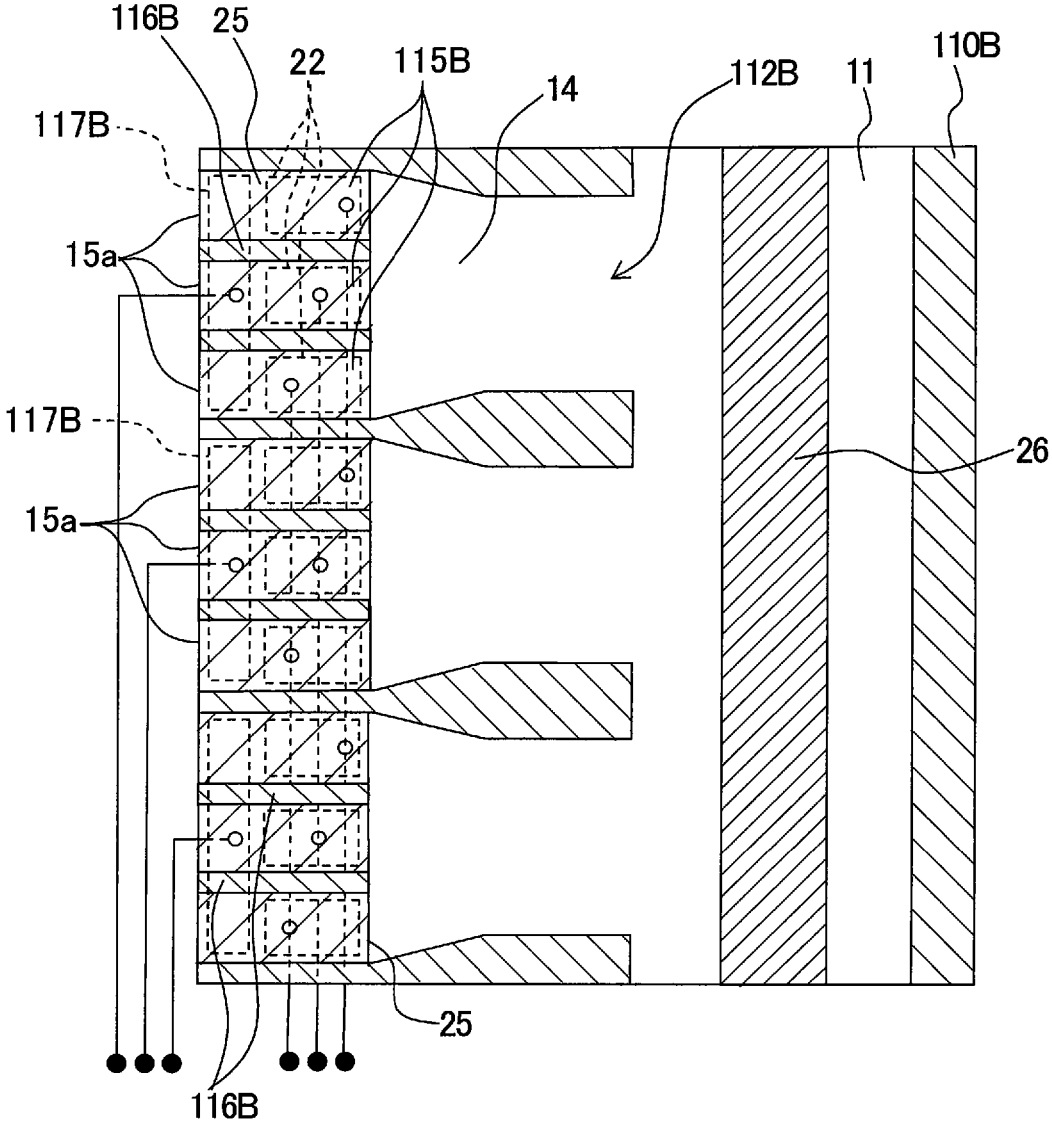
FIG. 10 is a horizontal cross-sectional view of an ink-discharge head of a first example in a second modified embodiment.

Therefore, to avoid such problem, as in a second example shown in FIG. 10, it is preferable that partition walls 116B which separate a plurality of individual channels 115B of each main ink channel 112B is extended up to a front surface of a head body 110B. In other words, each of the individual channels 115B may have the independent discharge port 35*a*, and a first electrode 117B may be formed across the individual channels 115B, in an area of these individual channels 115B, on a downstream side of an area in which the second electrodes 22 are formed.

Second Modified Embodiment

In the embodiment, each of the ink channels 12 has a main channel 14 having a wide channel width (channel cross-sectional area), which communicates with the common ink chamber 11, and the plurality of individual channels 15 is branched from this main channel 14. However, as shown in FIG. 11, partition walls 116C may be extended up to a common ink chamber 111C, and the main channel may be omitted, and a plurality of individual channels 115C of each main channel 112C may be branched directly from the common ink chamber 111C.

Figure 11:
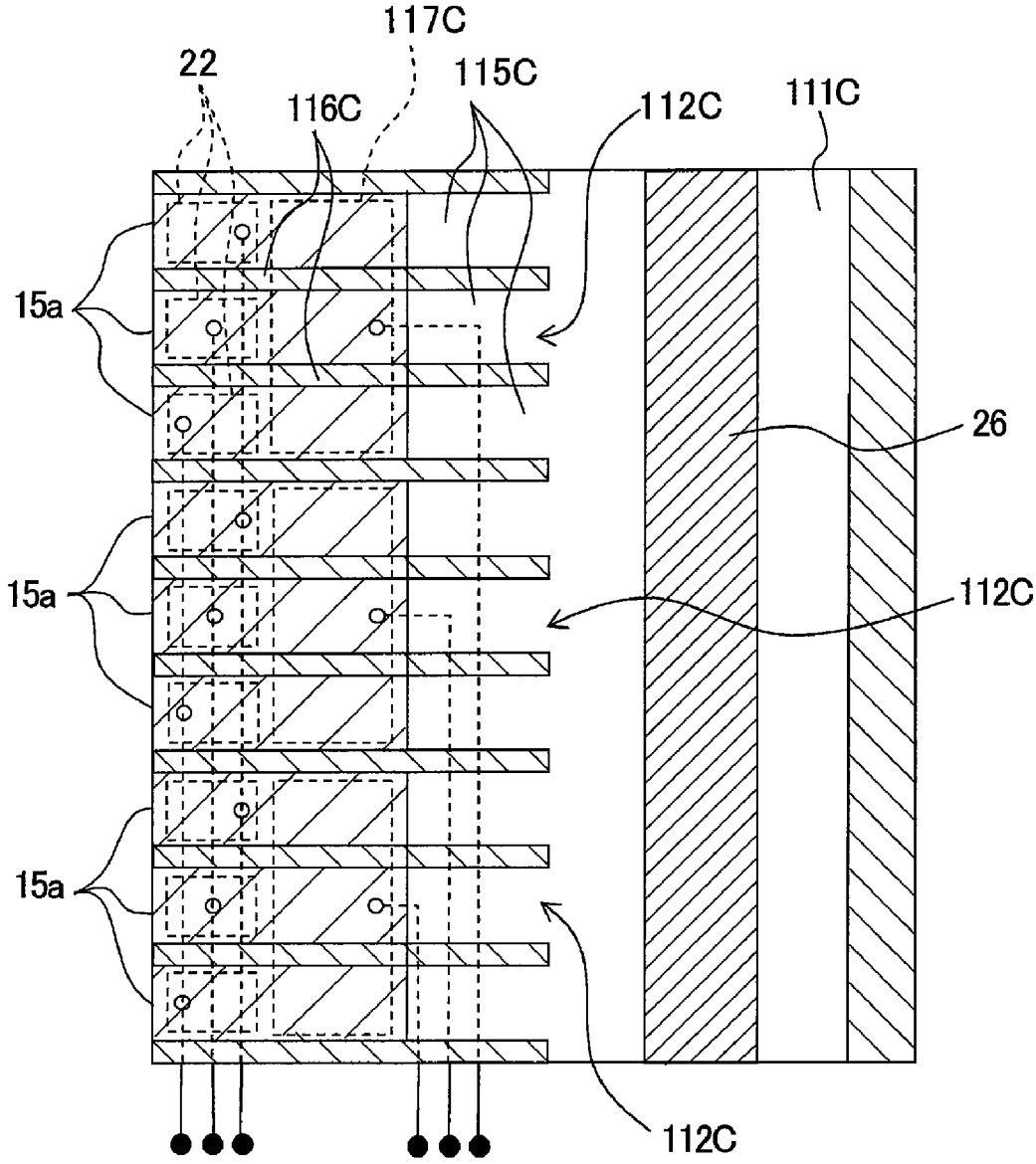
FIG. 11 is a horizontal cross-sectional view of an ink-discharge head of a second example in the second modified embodiment.

As shown in FIG. 11, a first electrode 117C of each of the ink channels 112C may be provided in common to individual channels 115C such that the first electrode 117C is arranged across the three individual channels 115C. In other words, the same electric potential is applied all the time to a portion of the first electrode 117C corresponding to each of the three individual channels 115C. In FIG. 11, the first electrode 117C is arranged on the upstream side of the second electrode 22.

However, as in the first example (refer to FIG. 9) and the second example (refer to FIG. 10) of the first modified embodiment described above, the first electrode 117C may be arranged on the downstream side of the second electrode 22 also in the second modified embodiment.

Third Modified Embodiment

Figure 12:
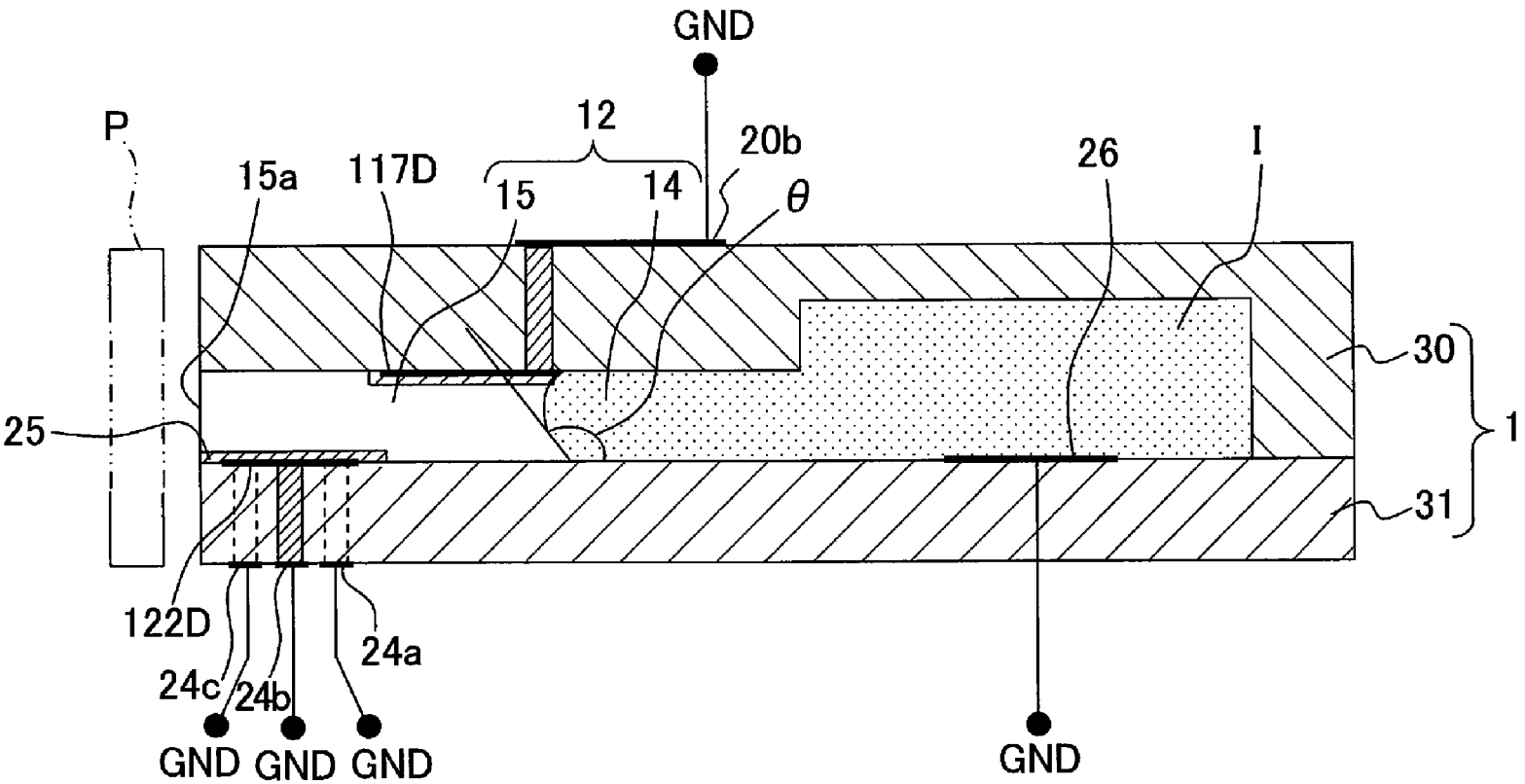
FIG. 12 is a horizontal cross-sectional view of an ink-discharge head of a first example in a third modified embodiment.
Figure 13:
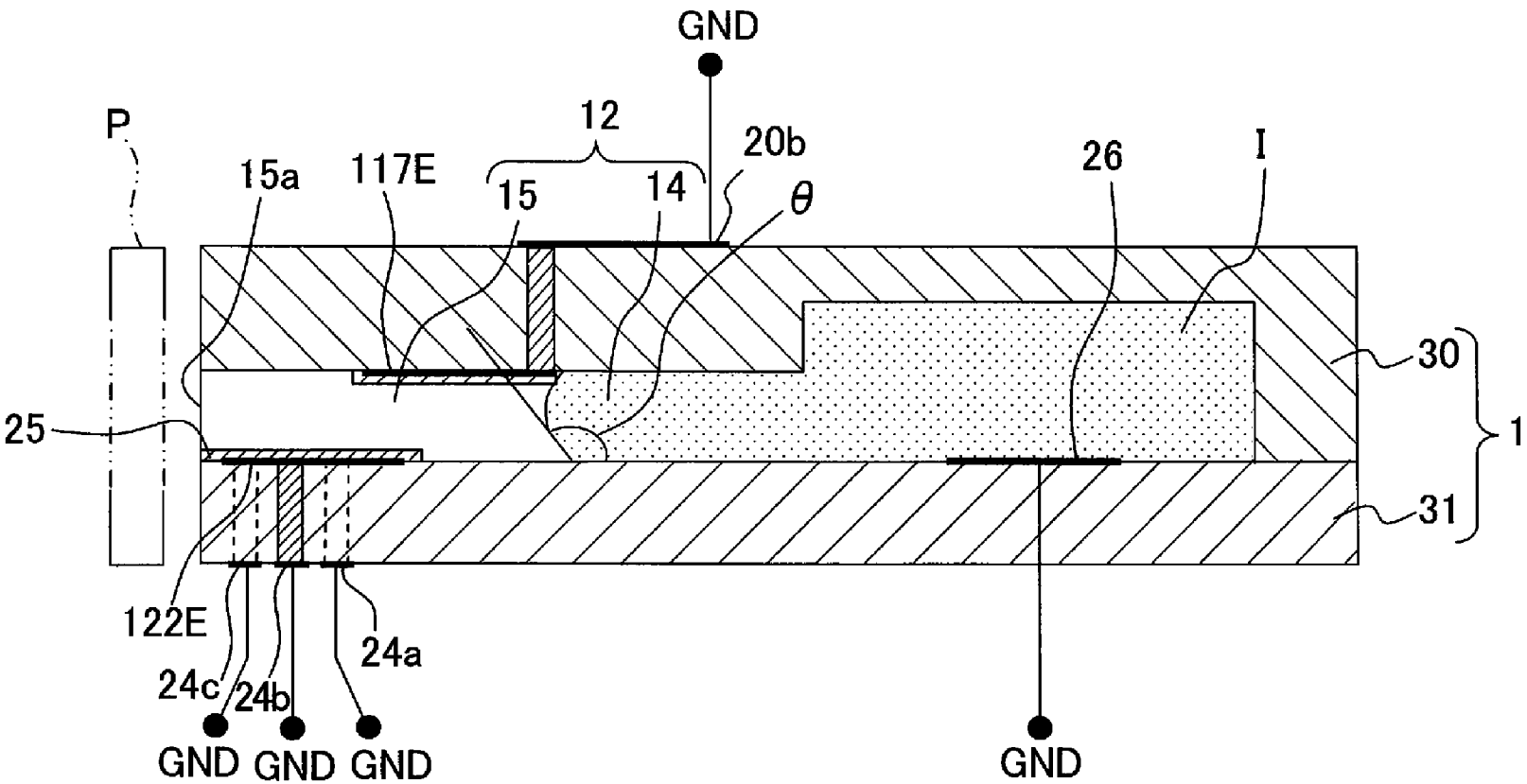
FIG. 13 is a diagram corresponding to FIG. 7 of an ink-discharge head of a second example in the third modified embodiment.

As shown in FIG. 12, a first electrode 117D may be formed on the upper surface of the main channel 14, and a second electrode 122D may be formed on a lower surface of the three individual channels 15. Both the first electrode 117D and the second electrode 122D are covered by the insulating layer 25. In this manner, the first electrode and the second electrode may not be arranged necessarily in the same plane. Furthermore, the first electrode and the second electrode may not be necessarily arranged to be overlapping in a plan view. For example, as shown in FIG. 13, a first electrode 117E and a second electrode 122E may be arranged to be overlapping in a plan view. However, when a distance between the first electrode and the second electrode is substantial, or when an area in which the first electrode and the second electrode overlap is too close to an opening of nozzles, there is a fear that the liquid may leak out from the opening. Therefore, it is desirable that the first electrode and the second electrode are arranged not to overlap, as in the abovementioned examples.

In the embodiment, the wirings 20 and 24 for applying the electric potential to the first electrode 17 and the second electrodes 22 are formed on the lower surface of the channel forming member 31, and the wirings 20 and 24 are connected to the first electrode 17 and the second electrodes 22 on the upper surface of the channel forming member 31 via the electroconductive material in the through holes 18 and 23, respectively (refer to FIG. 2). However, these wirings may be drawn directly from the first electrode 17 and the second electrodes 22, and may be drawn around on the upper surface of the channel forming member 31.

However, when the wirings are arranged on the channel forming surface of the ink channel 12, on the upper surface of the channel forming member 31, the ink in the ink channel 12 may make a direct contact with the wirings. Therefore, in a case of arranging the wirings on the upper surface of the channel forming member 31, the wirings may be arranged in another area of the ink channel 12 other than the channel forming surface (in other words, area in which the partition walls 13 and 16 are joined), or the wirings may be arranged on the channel forming surface, and also these wirings may be covered by an insulating layer.

The common electrode for stabilizing the electric potential is not required to be necessarily arranged in the common ink chamber, and when the wobbling (fluctuation) of the electric potential of the ink in the common ink chamber is small, the common electrode may be omitted. Moreover, in a case of arranging the common electrode, only when the common electrode makes an electrical contact with the ink, a position of arranging the common electrode and a shape of the common electrode etc. may be arbitrary.

The second electrode included in one of the electrode groups may not necessarily communicate with all of the other second electrodes included in the other electrode groups. For example, two kinds of electrode groups, that is, an electrode group which includes the second electrodes wired independently, and an electrode group which includes the second electrodes wirings commonly with the second electrodes of the other electrode group, may be mixed. Moreover, regarding the second electrodes which are mutually connected, position of the second electrodes in each of the electrode groups may not be the same. In other words, all of the second electrodes arranged at the left end in the electrode groups may not be necessarily in electrical conduction. Similarly, the second electrodes arranged at the center of the electrode groups, and the second electrodes arranged at the right end of the electrode groups may not be necessarily in electrical conduction, respectively. Moreover, the number of the second electrodes in each of the electrode groups may be arbitrary.

The embodiment and the modified embodiments described above are examples in which the present invention is applied to a printer which records an image by transporting an ink to a recording paper. However, the present invention is also applicable to other liquid transporting apparatuses which transport liquids other than ink. The present invention is also applicable to apparatuses such as an apparatus which forms a wiring pattern by transferring an electroconductive liquid in which metallic nano particles are dispersed, to a substrate, an apparatus which manufactures DNA chips by using a solution in which DNA is dispersed, an apparatus which manufactures display panels by using a solution in which an EL (electro luminescence) material such as an organic compound is dispersed, and an apparatus which manufactures a color filter for a liquid crystal display by using a liquid in which pigments for color filter are dispersed. Particularly, in the liquid transporting apparatus of the present invention, since no heat and high pressure are applied to the liquid, at the time of transporting a liquid in which biomedical tissues such as DNA, virus, and cells are dispersed, there is no fear of annihilating (deadening) and altering these biomedical tissues, virus, and cells etc.

Moreover, liquids which are used in these liquid transporting apparatuses are not restricted to a case in which the liquid is electroconductive, and a liquid is let to be electroconductive similarly as an electroconductive liquid, by dispersing an electroconductive additive in a non-electroconductive liquid.

What is claimed is:

1. A liquid transporting apparatus which transports a liquid having an electroconductivity, comprising:

a common liquid chamber in which the liquid is supplied;

a plurality of liquid channels through which the liquid supplied from the common liquid chamber flows, each of the liquid channels including a plurality of individual channels which communicate with the common liquid chamber;

a plurality of first electrodes arranged on the liquid channels respectively, each of the first electrodes being provided in common to the individual channels of one of the liquid channels;

a plurality of second-electrode groups arranged on the plurality of liquid channels respectively, each of the second-electrode groups including a plurality of second electrodes arranged on the plurality of individual channels of one of the liquid channels, respectively;

an insulating layer which covers the second electrodes of each of the second-electrode groups and each of the first electrodes of one of the liquid channels, a wetting angle of the insulating layer with respect to the liquid being decreased to be not more than a critical wetting angle when an electric potential difference between the liquid in the liquid channel and at least one of the first and the second electrodes is not less than a predetermined critical electric potential; and an electric potential applying mechanism which applies an electric potential to the second electrodes of each of the second-electrode groups and each of the first electrodes of one of the liquid channels, wherein a second electrode included in one of the second-electrode groups corresponds to another second electrode included in another second-electrode group to electrically connect with each other.

2. The liquid transporting apparatus according to claim 1, wherein each of the first electrodes and the second electrodes of each of the second-electrode groups of one of the liquid channels are arranged adjacently in a flow direction of the liquid.

3. The liquid transporting apparatus according to claim 1, wherein each of the liquid channels further includes a main channel which communicates with the common liquid chamber;

the individual channels of each of the liquid channels are branched from the main channel; and the first electrodes are arranged on the main channel in each of the liquid channels.

4. The liquid transporting apparatus according to claim 3, wherein a cross-sectional area of a portion, of the main channel, at which an upstream end of each of the first electrodes is positioned is smaller than a cross-sectional area of another portion of the main channel positioned at a downstream side of the main channel.

5. The liquid transporting apparatus according to claim 1, wherein each of the first electrodes is arranged, on the individual channels of one of the liquid channels, commonly for the individual channels of one of the liquid channels.

6. The liquid transporting apparatus according to claim 1, further comprising a common electrode which is arranged on a surface of the common liquid chamber, the common electrode being in a direct contact with the liquid in the common liquid chamber, and being kept at a predetermined reference electric potential all the time.

7. The liquid transporting apparatus according to claim 1, further comprising:

a first channel forming member having a form of a substantially flat plate, and including, on one surface thereof, a first partition wall which partitions the liquid channels, and a second partition wall which partitions individual channels of each of the liquid channels; and a second channel forming member having a form of a substantially flat plate, and including, on one surface thereof, the first electrodes, the second electrodes, and the insulating layer covering the first electrodes and the second electrodes, wherein the one surface of the first channel forming member is arranged to face the one surface of the second channel forming member, and the liquid channels are formed between the first channel forming member and the second channel forming member.

8. The liquid transporting apparatus according to claim 7, wherein through holes are formed in an area, of the second channel forming member, overlapping with the first electrodes and the second electrode respectively;

a plurality of wirings which connect the first electrodes, the second electrodes, and the electric potential applying mechanism are formed on an opposite-surface of the second channel forming member, the opposite-surface being opposite to the one surface; and the wirings are connected to the first electrodes and the second electrodes via an electroconductive material which is filled in the through holes.

9. The liquid transporting apparatus according to claim 1, wherein the second electrodes of each of the second-electrode groups are aligned in a predetermined direction such that a position of a second electrode included in one of the second-electrode groups is same as a position of another second electrode included in another second-electrode groups, the second electrode corresponding to another second electrode.

10. The liquid transporting apparatus according to claim 1, wherein the first electrodes and the second electrodes are formed in a same plane.

11. The liquid transporting apparatus according to claim 1, wherein the first electrodes and the second electrodes are formed in different planes.

12. The liquid transporting apparatus according to claim 2, wherein each of the first electrodes is arranged at a downstream side of the second electrode in the flow direction.

13. The liquid transporting apparatus according to claim 2, wherein each of the first electrodes is arranged at an upstream side of the second electrode in the flow direction.

14. The liquid transporting apparatus according to claim 1, where in the liquid is an ink.

15. The liquid transporting apparatus according to claim 1, wherein the insulating layer is formed of a fluororesin.

* * * * *